US012736308B2

(12) United States Patent
Phillips

(10) Patent No.: US 12,736,308 B2
(45) Date of Patent: Sep. 15, 2026

(54) ANTI-AIR MISSILE GUIDANCE TECHNIQUE

(71) Applicant: Craig Alan Phillips, King George, VA (US)

(72) Inventor: Craig Alan Phillips, King George, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 196 days.

(21) Appl. No.: 18/652,879

(22) Filed: May 2, 2024

(65) Prior Publication Data

US 2026/0016267 A1 Jan. 15, 2026

(51) Int. Cl.
*F41G 7/22* (2006.01)

(52) U.S. Cl.
CPC ..... *F41G 7/2246* (2013.01); *F41G 7/2206* (2013.01); *F41G 7/2286* (2013.01)

(58) Field of Classification Search
CPC ..... F41G 7/2246; F41G 7/2206; F41G 7/2286
See application file for complete search history.

(56) References Cited

U.S. PATENT DOCUMENTS 2,995,830 A * 8/1961 Jordan, Jr. ..... G06G 7/78 703/4
3,588,002 A * 6/1971 White ..... B64C 17/00 244/3.14
4,220,296 A * 9/1980 Hesse ..... F41G 7/303 244/3.14
5,721,680 A * 2/1998 Van Cleve ..... F41G 7/001 701/1
6,676,071 B1 1/2004 Phillips et al. ..... 244/3.15
6,776,369 B2 8/2004 Phillips et al. ..... 244/3.15
8,150,621 B1 4/2012 Phillips et al. ..... 701/411
8,513,580 B1 8/2013 Phillips ..... 244/3.21
(Continued)

OTHER PUBLICATIONS

N. Slegers et al., "Model Predictive Control of a Parafoil and Payload System" *J. of Guidance, Control & Dynamics* 28(4) 2005, 816-821. https://arc.aiaa.org/doi/pdf/10.2514/1.12251.

(Continued)

*Primary Examiner* — Bernarr E Gregory
(74) *Attorney, Agent, or Firm* — Gerhard W. Thielman

(57) ABSTRACT

A computer implementation processor is provided for directing a missile from a radar towards an interception point of a moving target. The processor includes a missile simulator module; a pre-launch module; a trajectory curvature module; and a guidance module. The missile simulator module determines look angle time to the interception point from the radar. This module determines the look angle time remaining to intercept, at which the angular difference between the line-of-sight to the interceptor and the target are below a threshold value. The pre-launch module provides an initial curvature gain value. The trajectory curvature module updates the curvature gain value from the look angle time. The simulator module receives the gain value in feedback. The guidance module receives the gain value and physical characteristic information for the missile and provides acceleration command to the missile to intercept the target.

9 Claims, 9 Drawing Sheets

(56) References Cited

U.S. PATENT DOCUMENTS

2002/0128806 A1* 9/2002 Anderson ..... F41G 7/006 703/2
2002/0192622 A1* 12/2002 Perry ..... F41G 7/006 434/11

OTHER PUBLICATIONS

P. O. M. Scokaert et al., "Suboptimal Model Predictive Control (Feasibility Implies Stability)" *IEEE Trans. on Automatic Control* 44(3) 1999, 648-654. https://ieeexplore.ieee.org/stamp/stamp.jsp?tp=&arnumber=751369.

J. D. Schierman et al., "A Reconfigurable Guidance Approach for Reusable Launch Vehicles" AIAA Paper 2001-4429, 2001.

C. F. Lin, *Modern Navigation, Guidance, and Control Processing*, Prentice-Hall 1991, §8.6.

P. Zarchan, *Tactical and Strategic Missile Guidance* 4/e Progress in Astronautics & Aeronautics 199 AIAA 2002 ch25.

T. L. Song, et al., "Time Optimal Impact Angle Control for Vertical Plane Engagements" *IEEE Trans. on Aerosp. & Electr. Sys.*, 35(2) 1999, 738-742. https://ieeexplore. ieee.org/stamp/stamp.jsp?tp=&arnumber=766954.

T. L. Song et al., "Impact Angle Control for Planar Engagements," *IEEE Trans. on Aerosp, & Electr. Sys.*, 35(4) 1999, 1439-1444. https://ieeexplore.ieee.org/stamp/stamp.jsp?tp=&arnumber=805460.

I. R. Manchester et al., "Circular Navigation Guidance Law . . . " *Proc. of the 41st IEEE Conf. on Decision & Control* 2, IEEE 2002, 1287-1292. https://ieeexplore.ieee.org/stamp/stamp.jsp?tp=&arnumber=1184692.

I. R. Manchester et al., "Circular Navigation Missile Guidance . . . " *J. of Guidance, Control, and Dynamics* 27(6) 2004, 1078-1083. https://arc.aiaa.org/ doi/pdf/10.2514/1.3371.

A. V. Savkin, "Problem of Precision Missile Guidance: LOR and HFrameworks" *IEEE Trans. on Aeros. & Electr. Sys.*, 39(3) 2003, 901-910. https://iecexplore.ieee.org/stamp/ stamp.jsp?tp=&arnumber=1238744.

R. J. Krieger, "Supersonic Missile Aerodynamic and Performance Relationships for Long-Range Mission Profiles" *J. of Spacecraft & Rockets* 21(3) 1984, 234-240. https://ieeexplore.ieee.org/stamp/stamp.jsp? tp=&arnumber=4788274.

P. Lu, "Asymptotic Analysis of Quasi-Equilibrium Glide in Lifting Entry Flight" *J. of Guidance, Control & Dynamics* 29(3) 2006, 662-670. https://arc.aiaa.org/dot/pdf/10.2514/1.15789.

N. S. Naidu et al., "Singular Perturbations and Time Scales in Guidance and Control of Aerospace Systems: A Survey" *J. of Guidance, Control & Dynamics* 24(6) 2001, 1057-1078. https://arc.aiaa.org/doi/pdf/10.2514/2.4830.

P. Adler, "Missile Guidance by Three-Dimensional Proportional Navigation" *J. of Appl. Phys.* 27(5) 1956, 500-507.

S. A. Murtaugh et al., "Fundamentals of Proportional Guidance" *IEEE Spectrum* 3(6) 1966, 75-85 https://ieeexplore.ieee.org/stamp/stamp.jsp?tp=&arnumber=5217080.

E. J. Ohlmeyer et al., "Generalized Vector Explicit Guidance", *J. Guidance, Control & Dynamics* 29(2) 2006, 261-268. https://www.researchgate.net/publication/245432667_Generalized_Vector_Explicit_Guidance.

E. J. Ohlmeyer, "Control of Terminal Engagement Geometry Using Generalized Vector Explicit Guidance" *Proc. of Am. Control Conf.* 1, IEEE 2003, 396-401. https://ieeexplore.ieee.org/stamp/stamp.jsp?tp=&arnumber=1238981 https://www.researchgate.net/publication/4039022_Control_of_terminal_engagement_geometry_using_generalized_vector_explicit_guidance.

C. A. Phillips, "Guidance Algorithm for Range Maximization and Time-of-Flight Control of a Guided Projectile" *J. of Guidance, Control & Dynamics* 31(5), 2008 1447-1455.

L. D. Dewell, "Fuel-Optimal Periodic Control and Regulation in Constrained Hypersonic Flight" *J. of Guidance, Control & Dynamics* 20(5) 1997, 923-932. https://arc.aiaa.org/doi/pdf/10.2514/2.4136.

M. Kim et al., "Terminal Guidance for Impact Attitude Angle Constrained Flight Trajectories" *IEEE Trans. on Aerosp. & Electr. Sys.*, aes-9(6) 1973, 852-859. https://ieeexplore.ieee.org/stamp/stamp.jsp? tp=&arnumber=4103230.

B. S. Kim et al., "Biased PNG Law for Impact with Angular Constraint" *IEEE Trans. on Aerosp. & Electr. Sys.*, 34(1) 1998, 277-288. https://ieeexplore.ieee.org/stamp/stamp.jsp?tp=&arnumber=640285.

* cited by examiner

Reproduction of Figure 3.21 in Zarchan 1990

670

Vaddi, S. S., Menon, P. K., and Ohlmeyer, E. J., "Target State Estimation for Integrated Guidance - Control of Missiles," *AIAA Guidance, Navigation, and Control Conference*, 2007

$$\underline{X} = \begin{bmatrix} R_x \\ R_y \\ R_z \\ V_x \\ V_y \\ V_z \\ Z_1 \\ Z_2 \\ C_{Dm} \\ \omega \end{bmatrix}$$

position states velocity states harmonic states modified drag & frequency states $$\dot{\underline{R}}^{NED} = \underline{V}^{NED}$$

$$\dot{\underline{V}}^{NED} = T_{ECEF}^{NED}\underline{G}^{ECEF} + QT_{VEL}^{NED}\begin{bmatrix} -C_{Dm} \\ Z_1 \\ Z_2 \end{bmatrix}$$

$$\begin{bmatrix} \dot{Z}_1 \\ \dot{Z}_2 \end{bmatrix} = \begin{bmatrix} 0 & -\omega \\ \omega & 0 \end{bmatrix}\begin{bmatrix} Z_1 \\ Z_2 \end{bmatrix}$$

$$\begin{bmatrix} \dot{C}_{Dm} \\ \dot{\omega} \end{bmatrix} = \begin{bmatrix} 0 \\ 0 \end{bmatrix}$$

Q = Dynamic Pressure

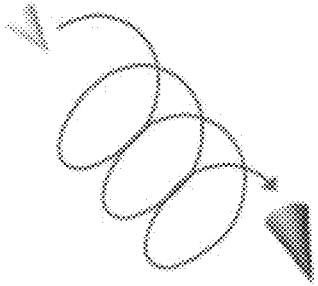

FIG. 8B

ANTI-AIR MISSILE GUIDANCE TECHNIQUE

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to missile guidance. In particular, the invention relates to techniques for improving radar track performance of an interceptor towards a target by controlling the relative geometry between the interceptor and target during the final phase of the flight. This process expedites feedback gain towards interception.

Some radar processing algorithms minimize the relative errors between a target and a missile interceptor when the angle between the line-of-sight from the ship radar to the interceptor and the line-of-sight from the ship radar to the target falls below a threshold value. This portion of the trajectory is labeled the Error Angle Reduced Error Space (ERAS). Miss distance of an interceptor under command guidance can be minimized when relative tracking errors between the interceptor and the target are minimized.

Homing of guided missiles against individual targets has been extensively studied for conditions with ideal relative tracking between interceptor and target. Proportional navigation laws have been proposed for three-dimensional engagements and the miss distances of missiles guided by these laws. Such influences include target maneuvers, heading errors from midcourse phase navigation errors, receiver noise, and radome aberrations. References include P. Adler, "Missile Guidance by Three-Dimensional Proportional Navigation" *J. of Appl. Phys.* 27(5) 1956, pp. 500-507; and S. A. Murtaugh et al., "Fundamentals of Proportional Guidance" *IEEE Spectrum* 3(6) 1966, pp. 75-85. These efforts have yielded both numerical and closed-form solutions. The proportional navigation laws provide a small miss distance against either a fixed target or a moving target, but do not provide control over the final velocity orientation.

Other efforts have identified methods to control both miss distance and final velocity orientation, such as E. J. Ohlmeyer et al., "Generalized Vector Explicit Guidance", *J. Guidance, Control & Dynamics* 29(2) 2006, pp. 261-268. In this arrangement, the final velocity orientation can be controlled by pre-planned approach, but does not provide a method to directly control the line-of-sight from the ship tracking sensor to intercept the target.

SUMMARY

Conventional missile guidance techniques yield disadvantages addressed by various exemplary embodiments of the present invention. In particular, various exemplary embodiments provide a computer implementation processor for directing a missile from a radar towards an interception point of a moving target so as to control the relative line-of-sight from the ship tracker to the interceptor and the target by controlling the instantaneous curvature of the interceptor trajectory.

The processor includes a missile simulator module; a pre-launch module; a trajectory curvature module; and a guidance module. The missile simulator module determines look angle time to the interception point for which the desired angle difference is estimated between the line-of-sight from the ship track radar to the interceptor and the target from the radar. The pre-launch module provides an initial curvature gain value to use in the guidance module. The trajectory curvature module updates the curvature gain value throughout the flight to achieve the desired time at which the angle between the lines-of-sight from the ship radar to the interceptor and the target from the look angle time.

The simulator module receives the gain value in feedback from the trajectory curvature model, which iterates the value of the trajectory curvature gain and estimates the time to minimize the angle between the lines-of-sight from the ship to the interceptor and to the target. The guidance module receives the gain value and physical characteristic information for the missile and provides acceleration command to the missile to intercept the target.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which:

FIG. 8B is a tabular view of characterization target maneuvers;

and

Figure 11:
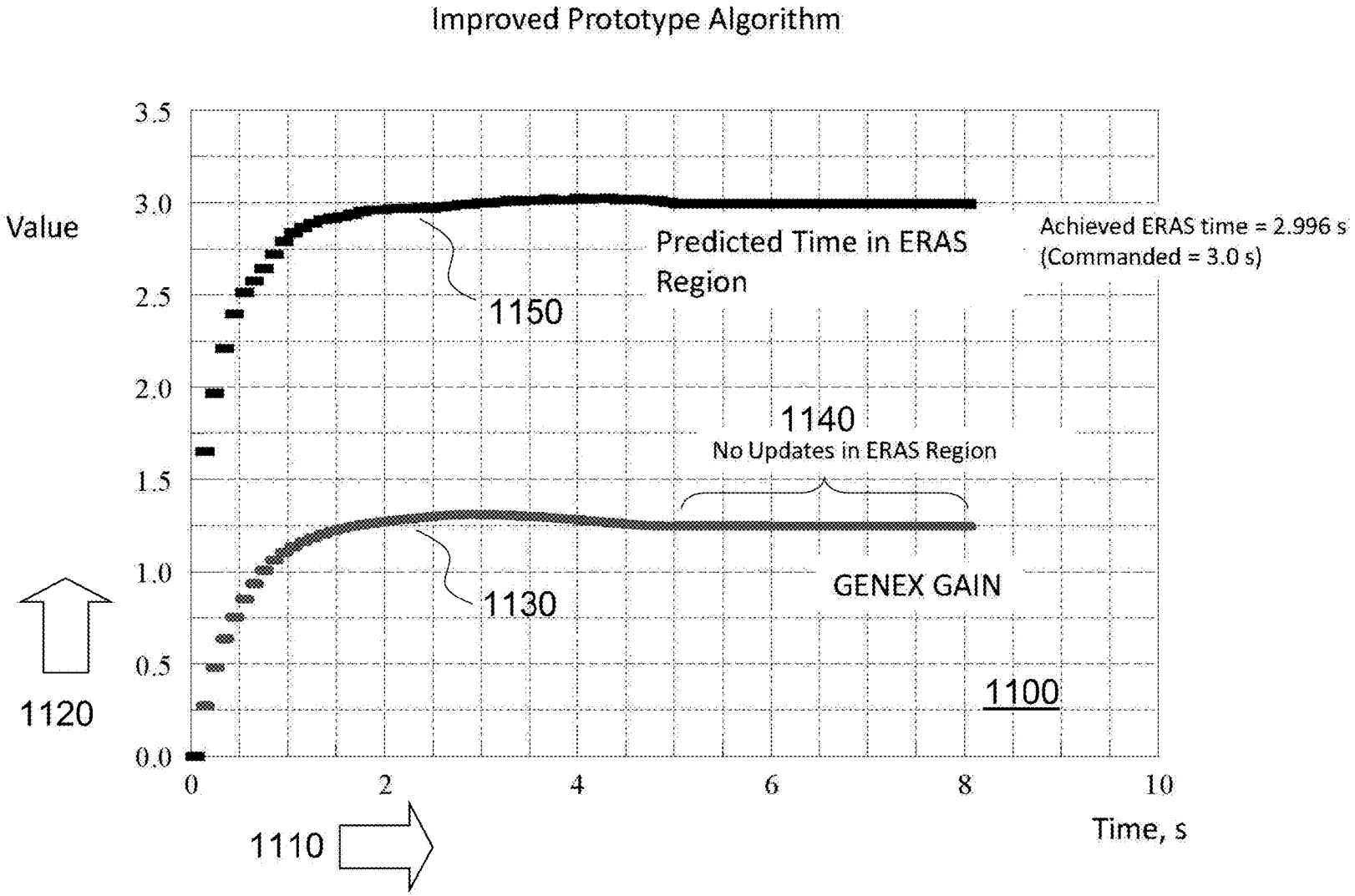

FIG. 11 is a graphical view of process improvement from curvature gain.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

In accordance with a presently preferred embodiment of the present invention, the components, process steps, and/or data structures may be implemented using various types of operating systems, computing platforms, computer programs, and/or general purpose machines. In addition, artisans of ordinary skill will readily recognize that devices of a less general purpose nature, such as hardwired devices, may also be used without departing from the scope and spirit of the inventive concepts disclosed herewith. General purpose machines include devices that execute instruction code. A hardwired device may constitute an application specific integrated circuit (ASIC), a field programmable gate array (FPGA), digital signal processor (DSP) or other related component.

The disclosure generally employs quantity units with the following abbreviations: length in meters (m), feet (ft) or nautical miles (nmi), mass in grams (g), time in seconds(s), angles in degrees) (°), force in newtons (N), temperature in kelvins (K), energy in joules (J) and frequencies in hertz (Hz). Supplemental measures can be derived from these, such as density in grams-per-cubic-centimeters ($g/cm^3$), moment of inertia in gram-square-centimeters ($kg\text{-}m^2$) and the like.

Proportional navigation laws have typically been developed with significant assumptions, such as linearity and constant velocity, which may limit their use in certain applications to relatively short segments of the trajectory such as the end game. Guidance laws that maneuver a weapon from its current position to a desired final position while controlling the orientation of the final velocity have been developed under the general term of explicit guidance.

Explicit guidance is documented by: G. Cherry, "General Explicit, Optimizing Guidance Law for Rocket-Propelled Spacecraft" AIAA Paper 64-638, August 1964; and is further explored in C. F. Lin, *Modern Navigation, Guidance, and Control Processing*, Prentice-Hall 1991, § 8.6; and P. Zarchan, *Tactical and Strategic Missile Guidance* 4/e, Progress in Astronautics and Aeronautics 199, AIAA 2002, chapter 25. A generalized form of explicit guidance can be derived from E. J. Ohlmeyer, "Control of Terminal Engagement Geometry Using Generalized Vector Explicit Guidance" *Proc. of Am. Control Conf.* 1, IEEE 2003, pp. 396-401.

Other guidance methods that attempt to control both miss distance and terminal geometry include M. Kim et al., "Terminal Guidance for Impact Attitude Angle Constrained Flight Trajectories" *IEEE Trans. on Aerosp. & Electr. Sys.*, aes-9(6) 1973, pp. 852-859; B. S. Kim et al., "Biased PNG Law for Impact with Angular Constraint" *IEEE Trans. on Aerosp. & Electr. Sys.,* 34(1) 1998, pp. 277-288; T. L. Song, et al., "Time Optimal Impact Angle Control for Vertical Plane Engagements" *IEEE Trans. on Aerosp. & Electr. Sys.,* 35(2) 1999, pp. 738-742; T. L. Song et al., "Impact Angle Control for Planar Engagements," *IEEE Trans. on Aerosp. & Electr. Sys.,* 35(4) 1999, pp. 1439-1444; I. R. Manchester et al., "Circular Navigation Guidance Law for Precision Missile Target Engagements" *Proc. of the* 41st *IEEE Conf. on Decision & Control* 2, IEEE 2002, pp. 1287-1292; 1. R. Manchester et al., "Circular Navigation Missile Guidance with Incomplete Information and Uncertain Autopilot Model" *J. of Guidance, Control, and Dynamics* 27(6) 2004, pp. 1078-1083; and A. V. Savkin, "Problem of Precision Missile Guidance: LQR and H Frameworks" *IEEE Trans. on Aeros. & Electr. Sys.,* 39(3) 2003, pp. 901-910.

In these, the cost function to be minimized is itself specified in terms of a user-defined parameter. This parameter, along with the initial and final flight-path angles, becomes a design parameter that the operator may adjust to achieve a particular performance. As with the proportional navigation, significant assumptions are made in the development of these laws that may restrict their use in some applications. The equations of motion associated with flight vehicle dynamics are highly nonlinear and require intricate aerodynamic and propulsion force models. To overcome these complications, simplified analysis models based on quasi-steady approximations have been employed. One such method is the energy-state approximation assuming quasi-steady equilibrium glide at constant dynamic pressure, which provides that flying at maximum lift-to-drag ratio maximizes the gliding range of the vehicle.

Examples of applications of the stick-fixed maximum lift-to-drag ratio flight can be found in R. J. Krieger, "Supersonic Missile Aerodynamic and Performance Relationships for Long-Range Mission Profiles" *J. of Spacecraft & Rockets* 21(3) 1984, pp. 234-240; and R. C. Wingrove, "Trajectory Control Problems in Planetary Entry of Manned Vehicles," *J. of Spacecraft & Rockets* 2(6) 1965, pp. 883-888.

Analysis has indicated that non-steady cruise solutions may produce fuel-optimal performance greater than that obtained for steady cruise as per L. D. Dewell, "Fuel-Optimal Periodic Control and Regulation in Constrained Hypersonic Flight" *J. of Guidance, Control & Dynamics* 20(5) 1997, pp. 923-932. In a similar fashion, investigations have been conducted into maximizing range performance for gliding vehicles by providing a near-equilibrium glide in which the guidance algorithm executes near phugoid-like motion.

Another algorithm from H. J. Kelley et al., "Boost-Glide Range-Optimal Guidance" *Optimal Control Applic. & Methods,* 3(3) 1982, pp. 293-298 presents an algorithm that provides a design parameter to control the flight-path angle between a steady dynamic pressure glide with feedforward anticipation of the specific energy loss in the glide angle and the stick-fixed (at maximum lift-to-drag) trajectory with natural phugoid motion. The resulting trajectory lies in the range in between these cases, and Kelley demonstrates that the trajectory produces range performance in excess of either of the two extremes. A rigorous examination of near equilibrium glide in entry flight of a gliding flight vehicle is presented in P. Lu, "Asymptotic Analysis of Quasi-Equilibrium Glide in Lifting Entry Flight" *J. of Guidance, Control & Dynamics* 29(3) 2006, pp. 662-670.

The energy model methods are unable to accommodate all of the boundary conditions, such as the final position and final velocity conditions without some type of correction or blending. The singular perturbation methods developed as an attempt to recover, in at least an approximate sense, the faster dynamics required to achieve these boundary conditions. An overview of the singular perturbation methods for the guidance and control problem is provided by N. S. Naidu et al., "Singular Perturbations and Time Scales in Guidance and Control of Aerospace Systems: A Survey" *J. of Guidance, Control & Dynamics* 24(6) 2001, pp. 1057-1078. The singular perturbation methods often require real-time numerical solution of the resulting two-point boundary value problem. For the cruise or glide vehicle, the outer solution determined in singular perturbation methods is similar to the solution found from the energy modeling methods.

An alternative numerical-based technique to maximize performance while satisfying terminal constraints is the Optimal-Path-to-Go algorithm, which employs an online optimal trajectory algorithm by J. D. Schierman et al., "Reconfigurable Guidance Approach for Reusable Launch Vehicles" AIAA Paper 2001-4429, 2001. In this technique, an online database of previously developed optimal trajectories is encoded and interrogated online at regular intervals. The current vehicle states are used as input to the algorithm to generate the optimal guidance commands to the desired terminal states.

These trajectory commands are used over the next trajectory segment, at which point they are updated. The model predictive control (MPC) approach provides a method for feedback control for nonlinear systems where the dynamics are slow relative to the computational update rate. In model predictive control, a nonlinear simulation of the system projects the states onto a future receding horizon or fixed terminal horizon and uses the estimated states at the horizon to determine the control action.

The technique is used in industrial control, but the advent of fast computer processing for onboard vehicle incorporation has attracted attention for controlling the slower processes on flight vehicles, such as the total time-of-flight to the target. A model predictive control strategy for a parafoil aircraft has been reported by N. Slegers et al., "Model Predictive Control of a Parafoil and Payload System" *J. of Guidance, Control & Dynamics* 28(4) 2005, pp. 816-821.

All of these prior art guidance algorithms fail to directly control the final phase of the interceptor's trajectory to maximize radar tracking performance as promised by select radar processing algorithms when the line-of-sight from the radar and the interceptor falls within a small angle relative to the line-of-sight from the radar to the target. Because of the unpredictable nature of the target (under maneuver), a preferred algorithm must be able to update the trajectory in real-time during the flight of the interceptor. Exemplary embodiments provide such an algorithm to enable this real-time control via a Model Predictive Control approach combined with the Generalized Explicit Guidance algorithm.

The proliferation of low-cost and low performance drones has led to an imbalance in the cost to defend and the cost to attack in modern warfare. Modern low-cost drones will be deployed in large numbers in a dispersed manner to avoid identification as a threat and may swarm and only become apparent as a threat at a very short range from the asset under attack.

This swarming behavior and the low cost of low performance drones using commercial technology has led to renewed interest in low cost and small interceptors that can successfully win the short battle and be deployed in sufficient numbers to counteract swarming drones. The desire for low cost and low volume drives the solution that minimizes the amount of control equipment on the interceptor.

Figure 1:
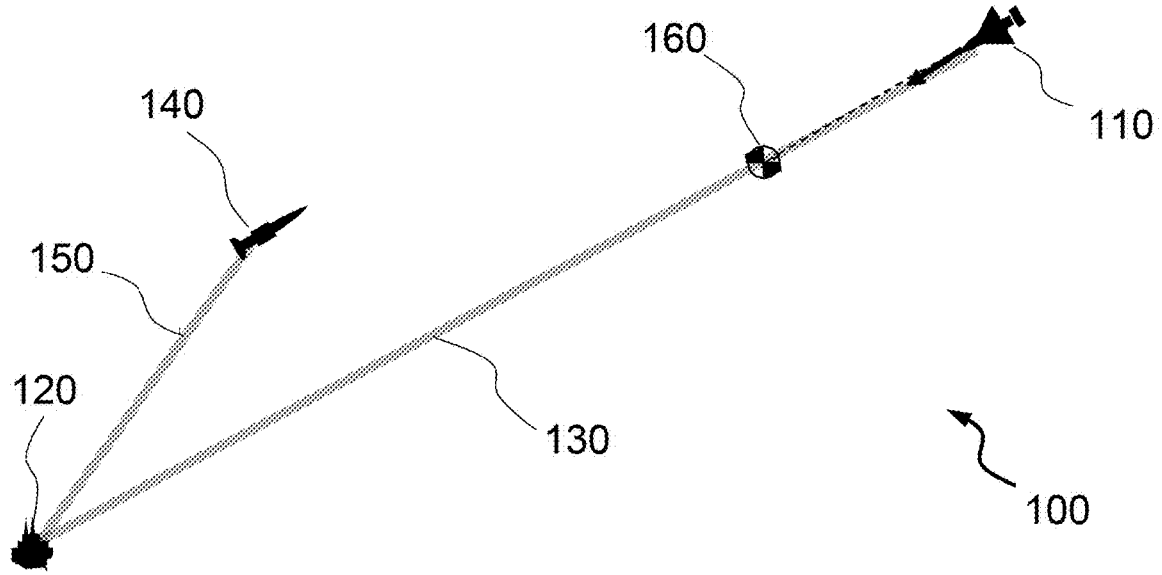
FIG. 1 is a scenario diagram view of a target engagement scene.

The exemplary guidance algorithm uses a generalized explicit (GENEX) algorithm framework to enable greater amounts of curvature for short ranges near the launch point. FIG. 1 shows a block diagram view 100 of a command guidance interception scenario. A hostile target 110 approaches to attack an asset 120, such as a radar system that acquires a target track 130 as line-of-sight. An interceptor missile 140 acquired by the radar 120 via an intercept track 150 is launched to interdict the target 110. Under exemplary embodiments, the missile 140 aims at a predicted intercept point (PIP) 160.

This requirement leads to an architecture similar to view 100 that shows a form of command guidance where tracking of the interceptor missile 140 and the target 110 is accomplished by a surface based radar 120 that uplinks the missile 140 and the target's position and velocity reports to the missile 140 to enable the missile 140 to compute its guidance commands to enable interception of the target 110.

Short range anti-air warfare against low performance threats can be characterized by high signal-to-noise ratio radar tracks on the target/threat and nearly co-linear intercepts. For these high signal-to-noise scenarios, the bias (or relatively constant errors) will dominate over the high-frequency random noise signals. The high-frequency random noise signals then form a very low noise floor which can be achieved if the relative biases between the interceptor missile and target track are removed.

For a phased array radar 120 with fixed face orientation, the bias errors may be a random function of the look angle (310 in FIG. 3) relative to the face. If the missile 140 is in the angular neighborhood centered about the radar track on the target 110, the bias errors for the missile 140 and target track may be the very close to one another enabling them to cancel in the interceptor missile guidance loop. That look angle region, dubbed the Error Reduced Angle Space (ERAS), is of an angular size depending on the type of radar and signal-to-noise ratio.

Figure 2:
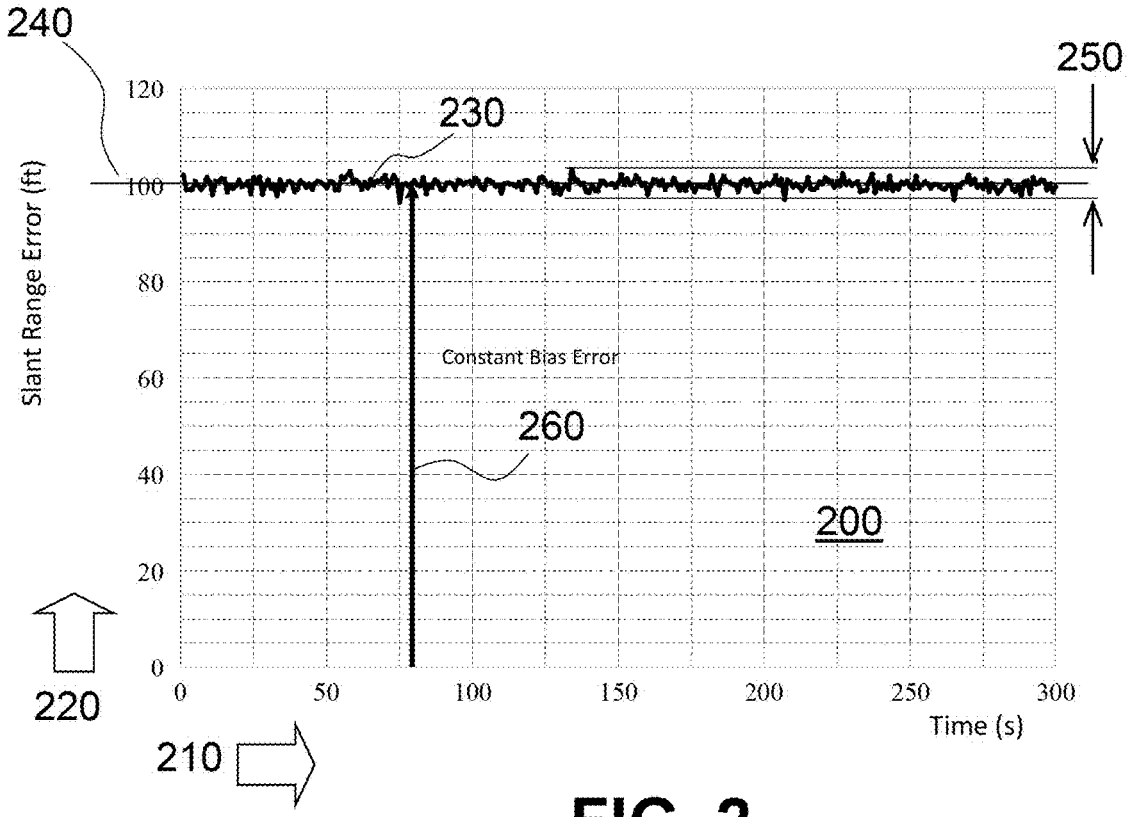
FIG. 2 is a graphical view of a signal track with error band.

FIG. 2 shows a graphical view 200 of temporal slant range for the short range anti-air ERAS. Time 210 (*s*) denotes the abscissa while slant range error 220 (*ft*) denotes the ordinate. A signal trace 230 with an average 240 at 100 ft includes an error band 250 that denotes a constant bias error 260 in the signal-to-noise ratio.

For these short range intercepts, directing the missile 140 onto a trajectory so that its track lies closely in angular space along the target track can significantly reduce the bias error 260 in the guidance of the missile 140. The scenario is shown in view 200.

Exemplary embodiments employ a guidance law that computes a commanded acceleration that is a function of the range unit vector $\hat{r}$ along the range-to-go vector from the current missile position to the intercept position, target velocity unit vector, and the desired final velocity vector v, for orientation of the interceptor missile 140. The commanded acceleration vector $\vec{a}_N$ for the missile 140 to intercept the target 110 is expressed as function:

$$\vec{a}_N = f(\hat{r}, \hat{v}, \hat{v}_f), \tag{1}$$

where $\hat{r}$ is the unit vector along the range-to-go vector from the current missile position to the intercept position, $\hat{v}$ is the unit vector along the current missile velocity vector (at the guidance update time) and $\hat{v}_f$ is the unit vector defined by the final desired flight path angle $\gamma_f$ and the final desired azimuth angle at the intercept $\psi_f$.

For purposes of explanation, track vectors are labeled as follows in relation to an interceptor missile M 140 in relation to a target T 110: $\vec{R}_M$ tracks the true missile position, $\overline{R}_{Mm}$ tracks the measured missile position, $\delta\vec{R}_M$ presents the error in measured missile position, $\vec{R}_{PIP}$ tracks the true predicted intercept point (PIP) with perfect knowledge of the target states, $\vec{R}_{PIPm}$ tracks the PIP target position with measurement error, $\delta\vec{R}_T$ presents the error in the target track position, R denotes the range magnitude from the missile 140 to the target, where subscripts M, T and m respectively denote missile 140, target 110, measurement.

The relative range vector from missile 140 to target 110 is corrupted by the errors in the two tracks given by:

$$\hat{r} + \delta\hat{r} = \frac{\left(\vec{R}_T + \delta\vec{R}_T\right) - \left(\vec{R}_M + \delta\vec{R}_M\right)}{R}, \tag{2}$$

where $\delta\hat{r}$ is the error in the relative range vector, $\delta\vec{R}_T$ is the error in the target track position, $\delta\vec{R}_M$ is the error in the missile track position and R is the magnitude of the range from the interceptor missile 140 to the target 110.

From a first order perspective, the position errors in the target 110 and missile 140 can be neglected so that:

$$R=\|\vec{R}_T-\vec{R}_M\| \tag{3}$$

as an approximation. The relative range error is then:

$$\delta\hat{r}=\frac{\left(\vec{R}_T+\delta\vec{R}_T\right)-\left(\vec{R}_M+\delta\vec{R}_M\right)}{R}-\hat{r}=\frac{\delta\vec{R}_T-\delta\vec{R}_M}{R}. \tag{4}$$

As the bias errors in the target and missile track approach in the ERAS, then error in the relative position vector $\delta\hat{r}$ reduces to zero such that in ERAS:

$$\delta\hat{r}=\frac{\delta\vec{R}_T-\delta\vec{R}_M}{R}\approx 0. \tag{5}$$

Based on eqns. (1) and (2), any error in the relative position vector results in an error in the commanded acceleration $\delta\vec{a}_N$ as:

$$\vec{a}_N+\delta\vec{a}_N=f(\hat{r}+\delta\hat{r},\hat{v},\hat{v}_f). \tag{6}$$

Once in the ERAS, the interceptor missile guidance and airframe require time to correct for the heading error from the previous error.

Time constant constitutes an important characterization of the responsiveness of the missile airframe under closed-loop control of autopilot. The time constant has units of seconds (s) and is used as a surrogate for more complicated measures of autopilot and airframe performance. In particular, the time constant represents the interval required for the airframe to achieve 63% of the commanded acceleration for a step command in acceleration. A more responsive airframe can have a shorter time constant than a more sluggish airframe.

Figure 3:
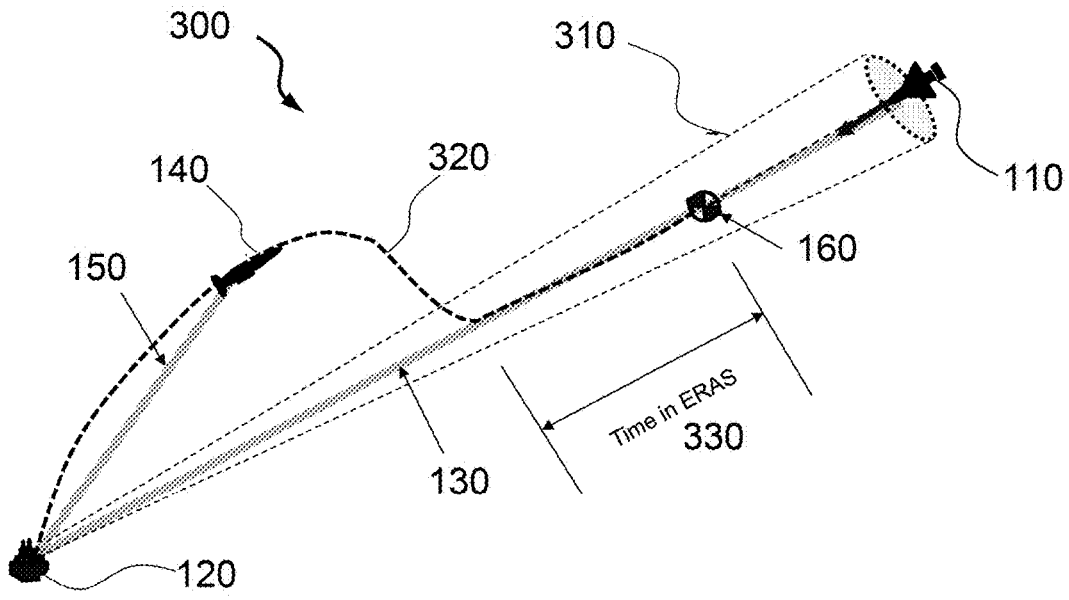
FIG. 3 is a scenario diagram view of that target engagement.

FIG. 3 shows a block diagram view 300 of the scenario from view 100. The target 110 operates in a neighborhood look angle 310 of conical ambiguity in relation to the radar 120. The missile 140 follows a phlugoid trajectory 320 towards the PIP 160. Upon reaching the radar track line-of-sight 130, an ERAS look angle time 330 can be determined for interception of the target 110.

Figure 4:
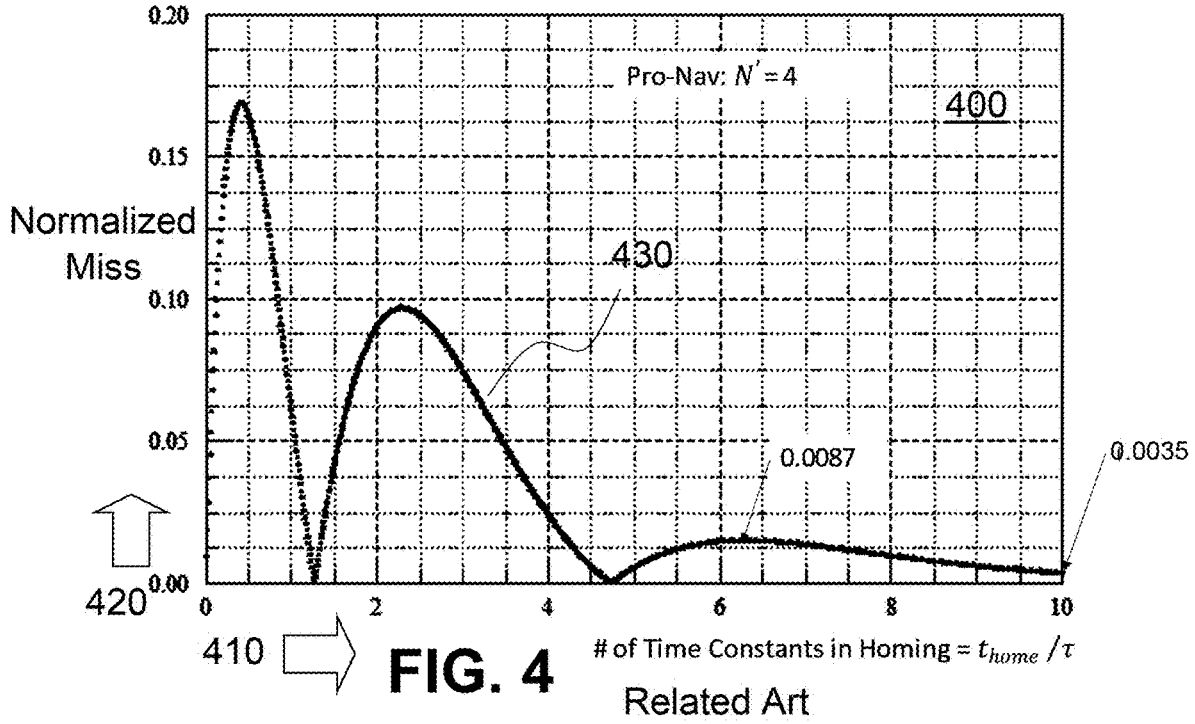
FIG. 4 Related Art
FIG. 4 is a graphical view of miss error relation to time constant.

FIG. 4 shows a graphical view 400 depicting the effect of time constants on miss distance from Zarchan, Tactical . . . Missile Guidance. Number of time constants 410 for homing denote the abscissa, while normalized miss distance 420 denotes the ordinate. A discrete trace 430 follows an attenuating trend with absolute oscillation, reaching a maximum of 0.165 before settling to near zero at ten time constants.

The normalized miss distance as a function of the number of time constants during the look angle time from entry into the ERAS and the intercept are given in view 400. Preferably between eight and ten time constants of homing after entry into ERAS. Thus, an interceptor missile trajectory that provides ten time constants of homing inside the ERAS is desirable.

Exemplary embodiments uniquely provide a composite guidance algorithm for combining the GENEX algorithm with a model predictive control (MPC) approach for the real-time control of the curvature of the trajectory of the missile 140 to minimize the time spent in the reduced error space of the radar. The exemplary framework enables the selection of a relatively few parameters by the designer to control the trajectory and mission to achieve complex non-tractable performance goals that could not be solved otherwise.

Figure 5:
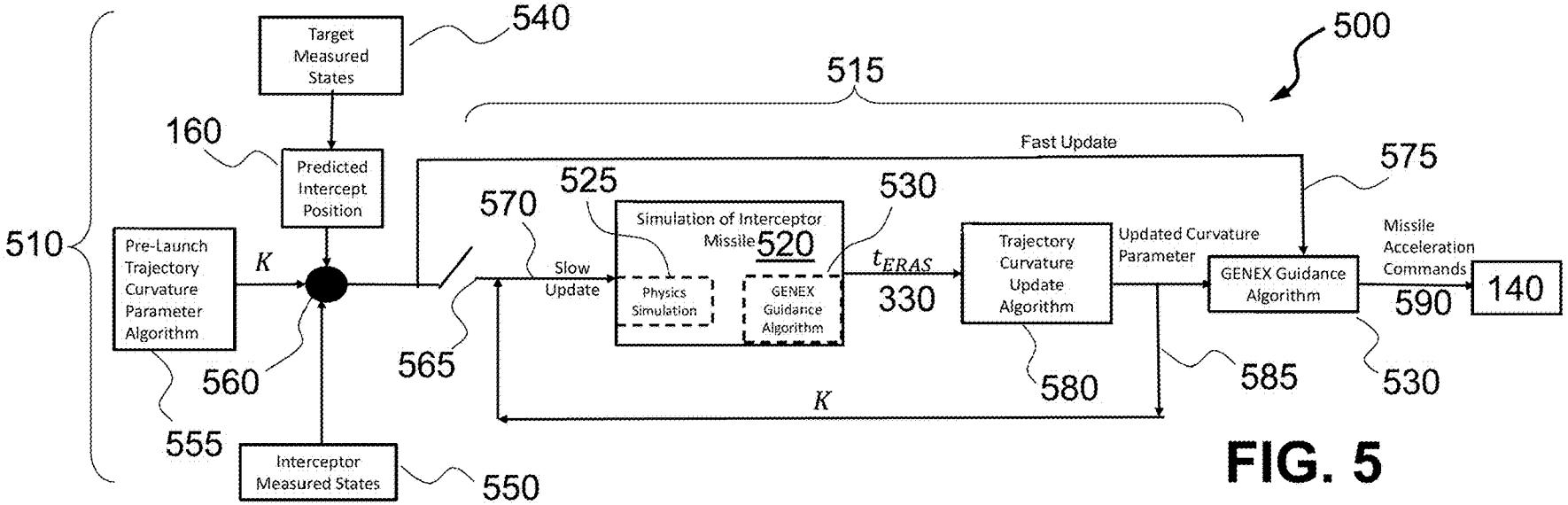
FIG. 5 is a block diagram view of a guidance control process with curvature gain feedback.

FIG. 5 shows a block diagram view 500 of the exemplary target resolving process 510 with an associated iterative portion 515. An exemplary simulator 520 of the missile 140 includes physical characterization 525 and a GENEX guidance algorithm 530 to provide ERAS look angle time 330. Inputs to the portion 515 include target measurement states 540, which provides the PIP 160, interceptor measurement states 550 and pre-launch algorithm 555 that provides a trajectory curvature parameter K. These inputs feed to a combined source 560 for the portion 515 to a gate switch 565. The inputs pass through a slow update loop 570 to the simulator 520 and also bypass through a fast update loop 575. The slow update loop 570 provides a feedback signal 585 with an updated curvature parameter K that returns to the simulator 520. Both loops 570 and 575 provide inputs to a GENEX guidance algorithm 530 to provide missile acceleration commands 590 to the missile 140.

Figure 6:
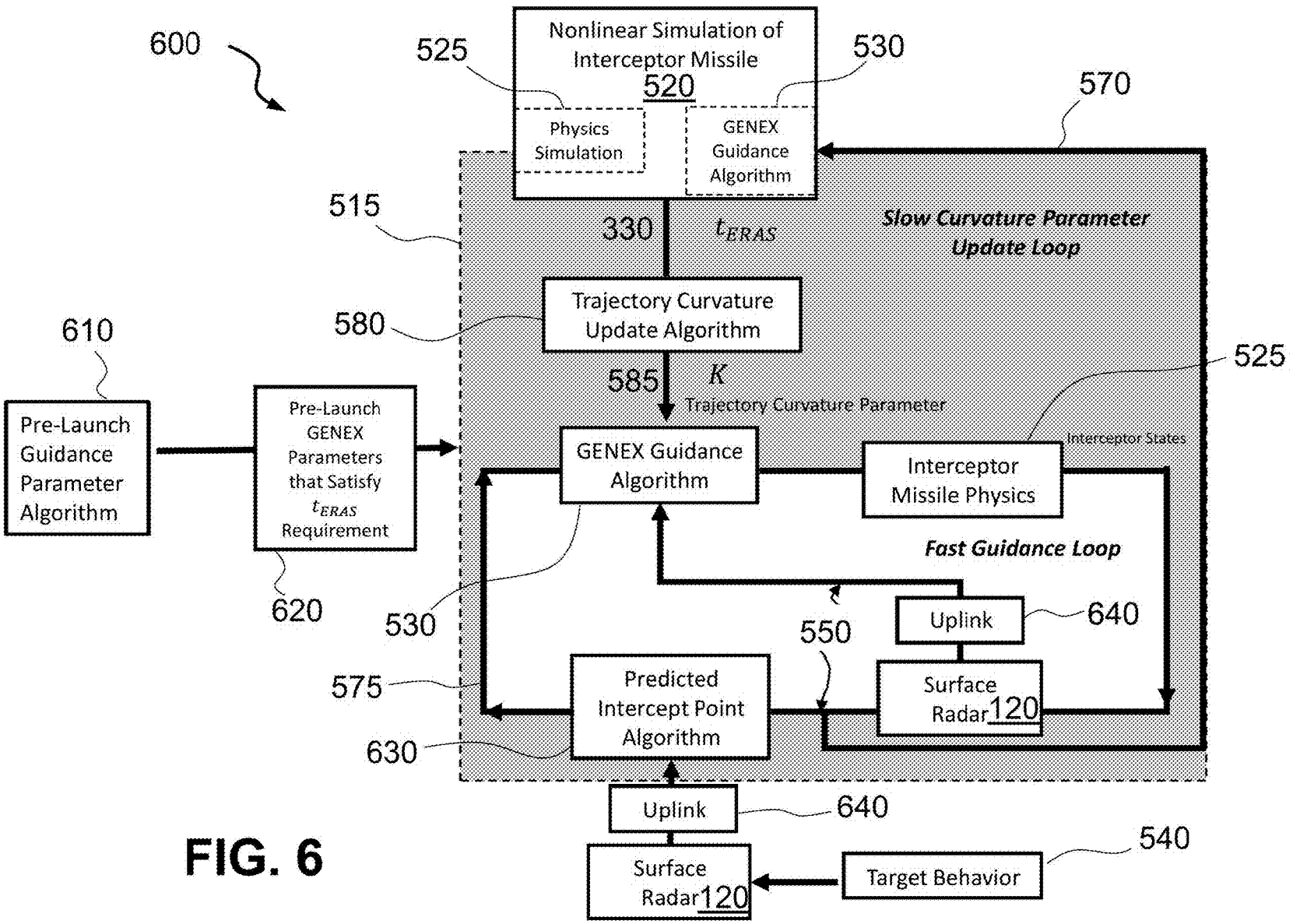
FIG. 6 is a block diagram detail view of the guidance control process.

FIG. 6 shows a detail block diagram 600 of the iteration portion 515, including the simulator 520 and the slow and fast loops 570 and 575. This shows the benefit of the PIP approach to guidance. Further inputs include a pre-launch guidance parameter algorithm 610 and a pre-launch GENEX parameters 620 that satisfy the ERAS time requirement. The fast loop 575 includes interceptor physical characteristics 525, GENEX guidance 530 and inputs from a PIP algorithm 630. The radar 120 receives target behavior 540 and provides this information to the GENEX guidance 530 and the algorithm 630 via uplinks 640.

As shown in views 500 and 600, the components unique to exemplary embodiments include the following elements:

(1) Missile guidance GENEX algorithm 530 that provides missile acceleration commands based on the missile and target relative states (position and velocity).

(2) An algorithm that provides a non-linear simulation 520 of the missile 140 that outputs the estimated time 330 in the ERAS region given the current missile and target state observations 525 and 540 from the radar 120. This algorithm may be installed on either the interceptor missile 140 or the surface platform 120. In the former case, the uplink 640 provides the missile and target state observations 525 and 540. In the latter, the uplink 640 provides the interceptor acceleration commands 590.

(3) An algorithm 580 that updates the optimal trajectory curvature parameter based on the outputs of simulator 520 and provides the updated parameter to guidance 530.

(4) Pre-launch algorithm 610 that computes the GENEX guidance parameters previously selected by trajectory design studies, being a function of the intercept geometry and target state observations at missile launch.

(5) Uplink 640 that provides either the interceptor missile acceleration commands 590 of the missile and target state observations 525 and 540 from radar 120.

(6) An algorithm 630 that determines the PIP 160.

(7) Surface Radar 120 that provides missile and target state observations 525 and 540 to include but not limited to position on a frequent update rate.

The exemplary Guidance Algorithm 530 uses Generalized Explicit (GENEX) protocol that was created to enable greater amounts of curvature for short ranges near the missile's launch point. This ability to control the curvature early in the flight provides an ideal basis to control the interceptor trajectory for short range anti-air defense to enable adequate time 330 in the small error angular space 310 in ERAS.

The creation of the guidance algorithm 530 requires a cost function J that minimizes control activity weighted by the inverse of a power of the time-to-go T to intercept. This enables greater control activity earlier in the flight when the time-to-go T is longer. This provides the needed early curvature needed to achieve the "up and under" trajectories near the launch point. The cost function J is presented as follows:

$$J = \int_0^{T_0} \frac{u^2}{2T^k} dT, \tag{7}$$

where $T_0$=the time-to-go (or time remaining) at the current time (meaning the start of the problem), u is the commanded acceleration $\ddot{z}$ normal to the line-of-sight from the missile position to the predicted intercept such that u=$\ddot{z}$, T is the time-to-go (or time remaining) and k is a denominator exponent. This cost function expression may be written equivalently as:

$$J = \int_{t_0}^{t_f} \frac{\ddot{z}^2}{2(t_f - t)^k} dt, \tag{8}$$

where t is time.

As with most optimal control problems, the cost function J is selected to minimize the control activity defined as the commanded acceleration along to the line-of-sight z axis performed in real-time. The denominator exponent k is a parameter related to optimal solutions to the Minimum Principle to be generated. The resulting set of optimal solutions may be evaluated in a full non-linear trajectory simulation to determine the best value for use in the real world application.

As with most guidance law derivations, the effect of gravity is ignored in the derivation (and cost function), but added later in the implementation as a gravity bias. The problem is subject to the following constraints: The missile strikes the PIP 160 at time $t_f$:

$$z(t_f)=0 \tag{9}$$

The missile velocity vector at intercept must achieve a proscribed final orientation:

$$\dot{z}(t_f)=\dot{z}_f, \tag{10}$$

where $\dot{z}_f$ is commanded velocity at the intercept time $t_f$.

The GENEX commanded acceleration normal to the missile velocity vector $\vec{a}_N$ is given by:

$$\vec{a}_N = \frac{V^2}{R}[K_2(\hat{r} - \hat{v}\cos\delta) - K_1(\hat{v}_f - \hat{v}\cos\mu)], \tag{11}$$

where as before, $\hat{r}$ is the unit vector along the range-to-go vector from the current missile position to the intercept position, $\hat{v}$ is the unit vector along the current missile velocity vector (at the guidance update time), $\hat{v}_f$ is the unit vector defined by the final desired flight path angle $\gamma_f$ and final desired azimuth angle at the intercept $\psi_f$, R is the remaining slant range to the intercept (magnitude of the range-to-go vector), and V is the current speed of the missile 140 (magnitude of the current velocity).

The cosine values are expressed as:

$$\cos\delta = \hat{r}\cdot\hat{v}, \tag{12}$$

$$\text{and } \cos\mu = \hat{v}_f\cdot\hat{v} \tag{13}$$

for angles δ and μ. GENEX gain values $K_1$ and $K_2$ are computed as:

$$K_1 = -(K+1)(K+2), \tag{14}$$

$$\text{and } K_2 = (K+2)(K+3), \tag{15}$$

where K is a trajectory curvature parameter.

Implementation of the GENEX guidance requires that the solution updates every guidance cycle with the current estimates of missile state and the predicted intercept point. By updating the predicted intercept point, the GENEX guidance law can intercept maneuvering targets 110. The PIP guidance rules permit a separation of the guidance to the terminal states and the estimation of the target future trajectory. This separation enables arbitrarily sophisticated trajectory estimation methods.

A gravity bias should be added to the commanded acceleration of eqn. (11) before being passed to the autopilot. This yields a guidance relation of the form:

$$\vec{a}_N = \frac{V^2}{R}[K_2(\hat{r} - \hat{v}\cos\delta) - K_1(\hat{v}_f - \hat{v}\cos\mu)] - \vec{g}, \tag{16}$$

where $\vec{g}$ is the local gravity acceleration vector.

During implementation design, the guidance designer has the option of selecting three parameters that specify the trajectory when using GENEX guidance. These include the flight path angle $\gamma_0$ of the missile either at launch (via a trainable launcher) or after the end of short pitch-over from vertical launch, the flight path angle $\gamma_f$ of the missile either at the predicted or actual intercept point, and the trajectory curvature parameter K.

Exemplary embodiments provide parameters for the Error Reduced Angle Space (ERAS) region for the missile 140 to intercept the target 110. This includes estimated ERAS time $t_{ERAS}$ 330. To ensure sufficient time $t_{ERAS}$ 330 for interception, the K value will be anti-parallel to the target's predicted velocity vector at the intercept. Thus, an accurate prediction of the target's future behaviors after missile launch is an important aspect of exemplary embodiments. The trajectory curvature parameter K provides significant design freedom to determine the value of time $t_{ERAS}$ 330 that may be obtained. For the pre-launch algorithms 555, 610 and 620, these three parameters should be selected to achieve the required value of time $t_{ERAS}$ 330 for each intercept.

Additionally, the value of the parameters should be selected to enable sufficient authority for the in-flight updates to correct for unknown target maneuvers. These may be optimized using digital simulations of the flight using any desired level of fidelity simulation and stored into an implemented algorithm à priori. View 600 shows an example of the curvature control available with the GENEX algorithm 530 by varying the curvature parameter K.

Figure 7:
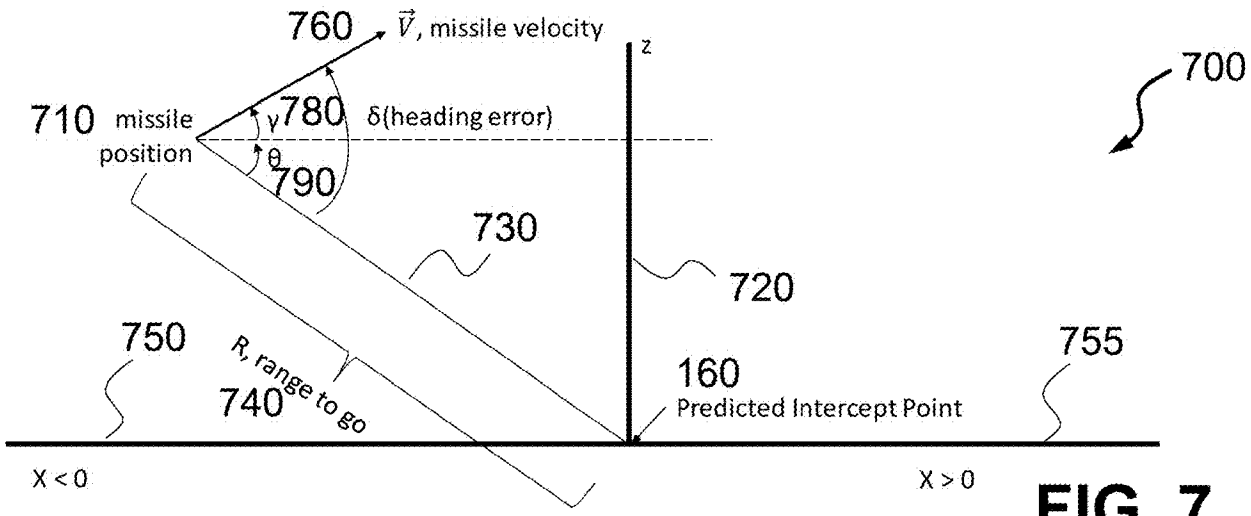
FIG. 7 is a vector diagram view of the missile direction in relation to the target.

FIG. 7 shows a vector diagram view 700 of the missile 140 from its position 710 towards the PIP 160 along the z intercept direction 720. Missile-to-PIP vector 730 corresponds to a range-to-go 740. The PIP 160 intersects a ground axis and the intercept direction 720, with values ahead 750 and behind 755. Missile velocity 760 from position 710 deviates from true by heading error angles γ 780 and θ 790 in opposite z directions 720.

Figure 8A:
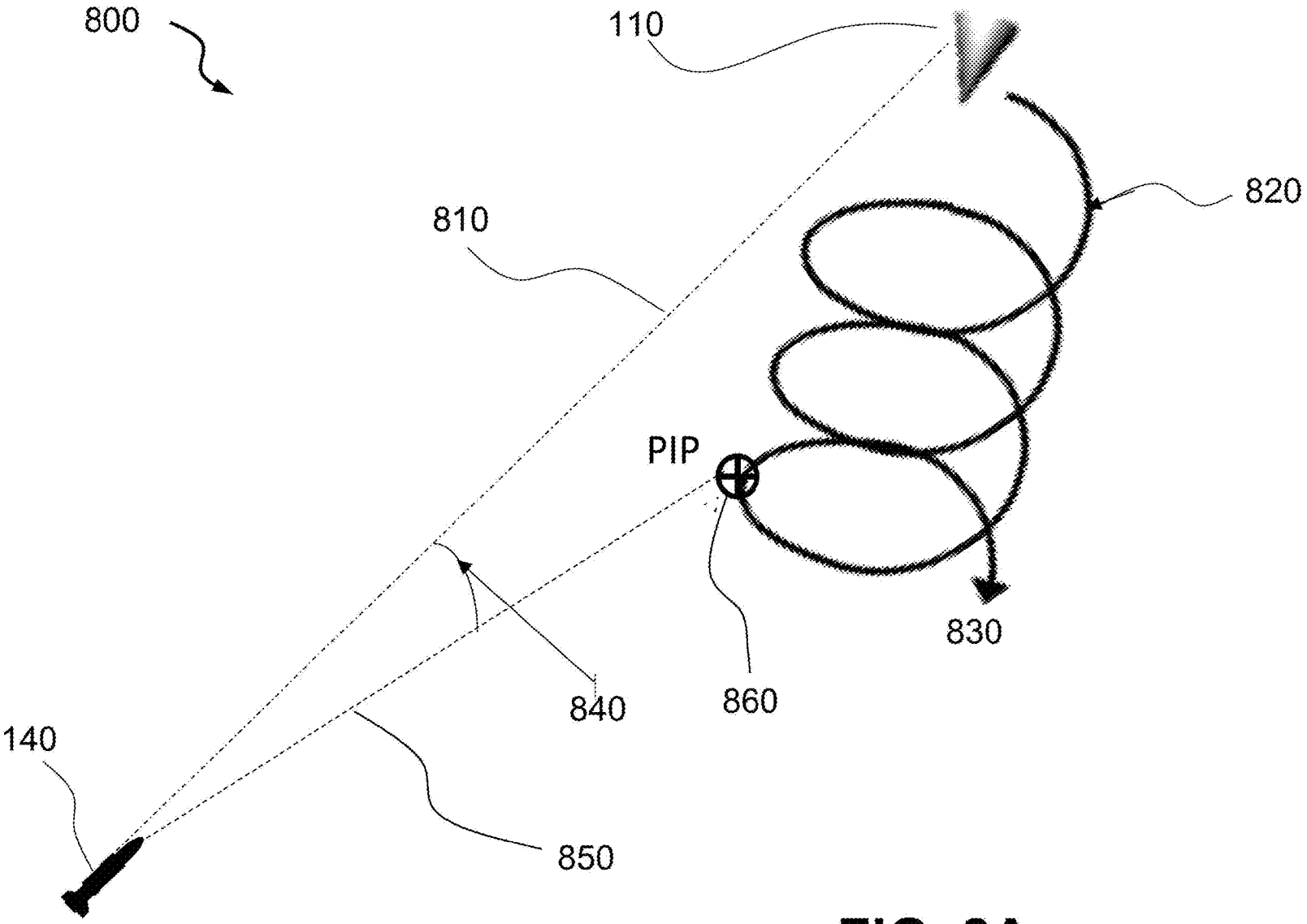
FIG. 8A is a scenario diagram view of a maneuvering target.

FIG. 8A shows a block diagram view 800 of an evasion scenario by the target 110 with line-of-sight 810 from the missile 140. The target 110 engages a spiral evasion trajectory 820 ultimately towards heading 830. With dual iteration loops 570 and 575, the missile 140 redirects its direction by angle 840 towards a revised heading 850 towards a new PIP 860 at which to engage the target 110. FIG. 8B shows a tabular view 870 from Vaddi, "Target State Estimation" of vectors and arrays employed to calculate the evasive trajectory 820 from which the missile 140 revises its heading 850.

Figure 9:
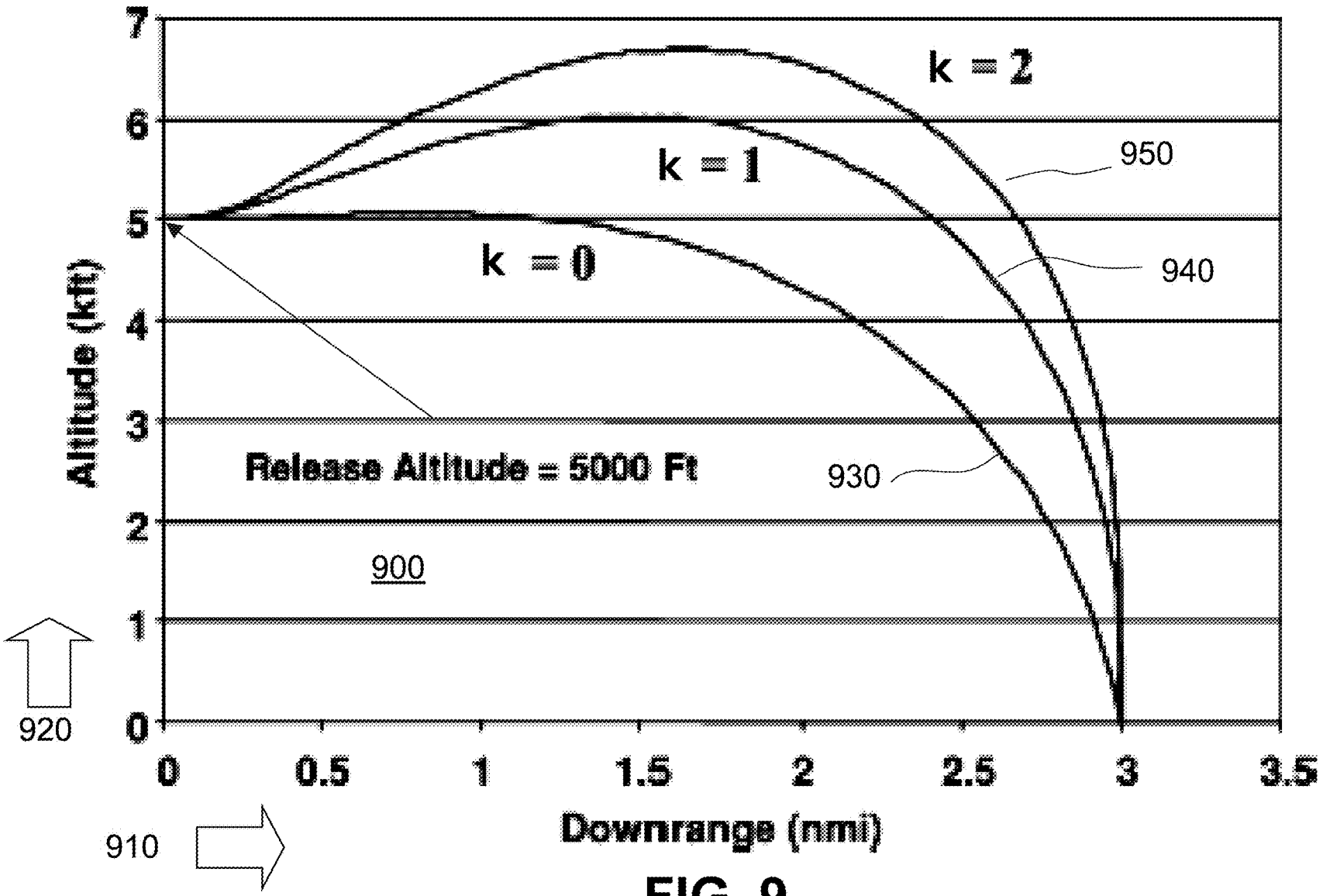
FIG. 9 is a graphical view of curvature gain effect.

FIG. 9 shows a graphical view 900 of effects from curvature parameter K for trajectories engaging a ground target. Downrange distance 910 (nautical miles) denotes the abscissa, while altitude 920 (thousands of feet) denotes the ordinate. Release occurs at five thousand feet altitude from which descent results in ground destination at 3.0 nmi from release. Trajectories are shown for K=0 930, K=1 940 and K=2 940, with the latter two values providing between one and two thousand feet of lift before target approach.

Figure 10:
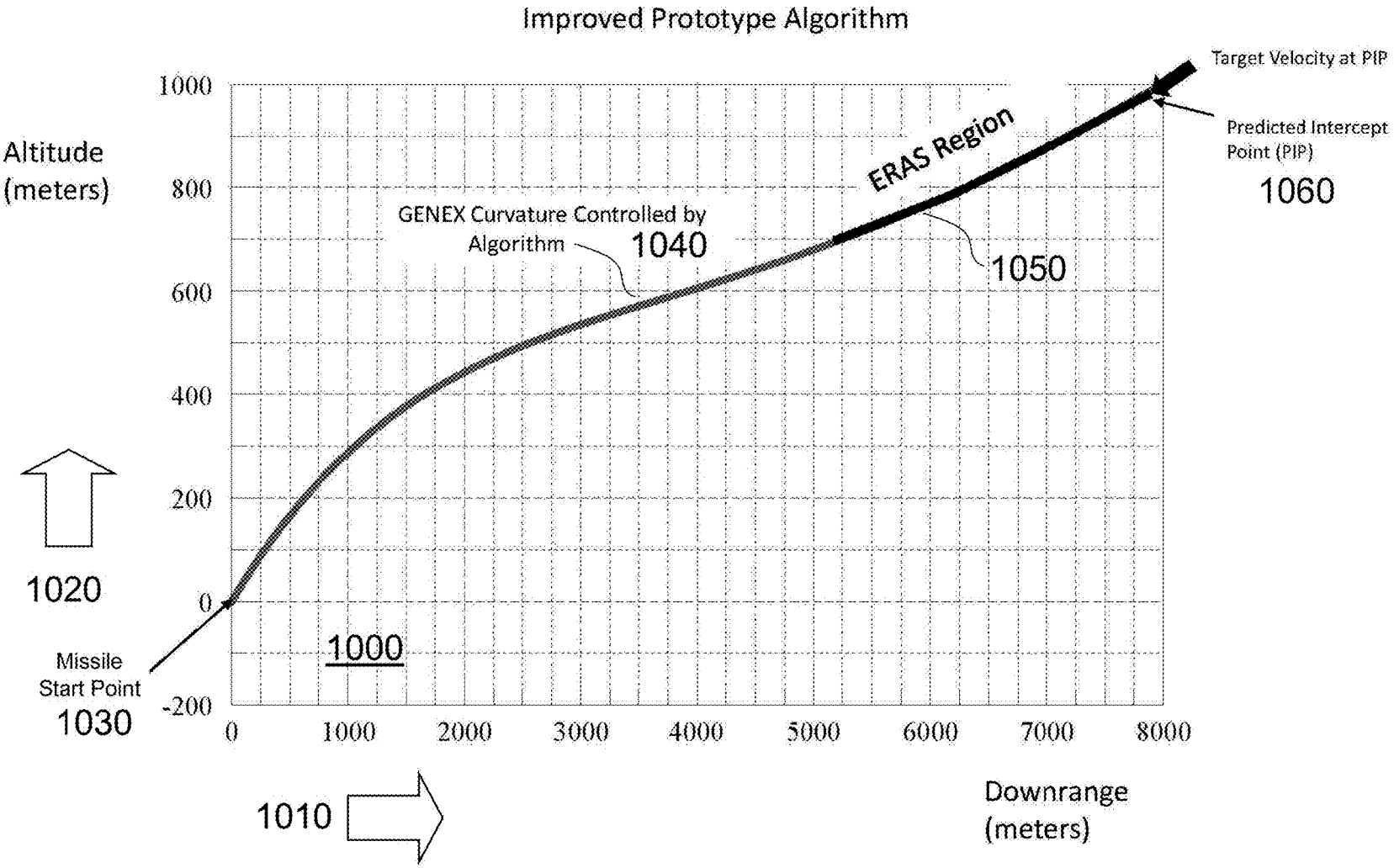
FIG. 10 is a graphical view of processor influence on missile track.

FIG. 10 shows a graphical view 1000 of range and altitude for missile intercept. Downrange 1010 (*m*) denotes the abscissa, while altitude 1020 (*m*) denotes the ordinate. The missile 140 launches from the origin as its start point 1030. The exemplary algorithm provides a GENEX curvature trajectory 1040 to just beyond five thousand meters downrange, after which the exemplary algorithm maintains the interceptor in the ERAS region 1050 for control until reaching the PIP 160 for interception of the target 110.

FIG. 11 shows a graphical view 1100 of value gain from the curvature parameter. Time 1110 (*s*) denotes the abscissa, while parameter value 1120 denotes the ordinate. A first trace 1130 presents GENEX curvature gain from zero to 1.25 after two seconds and resettling there after five seconds, with no updates 1140 in ERAS region. A second trace 1150 presents predicted time in ERAS region from zero to reach 3.0 after two seconds and remaining approximately constant thereafter.

The values of the three parameters are usually coded into tables as a function of the altitude and downrange of the PIP 160 at launch. The Fire Control algorithm interpolates the values of the three GENEX parameters and passes them to the guidance algorithm 530 at launch.

The second component of exemplary embodiments is an algorithm 530 that provides a non-linear simulation 520 of the missile 140 that outputs the estimated time in the ERAS region given the current state observations of the missile and target 110 from the radar 120. This algorithm 530 may be installed either on the missile 140 or the surface platform. In the former case, the uplink 650 provides the missile and target state observations. In the latter, the uplink 650 provides the interceptor acceleration commands 590.

The simulation 520 can provide a reasonably accurate value of the missile states and the estimated time 330 in the ERAS region time $t_{ERAS}$ 330 by including the missile flight physics 525 in the algorithm at the proper level of fidelity. The real-time inputs to the algorithm include the current estimates or observation of the missile states (position and velocity) and the predicted intercept point (PIP) 160. The à priori inputs to the algorithm 530 include the missile physics descriptions 525 and the current value of the trajectory curvature parameter 585. The output of the algorithm is the $t_{ERAS}$ time value.

In the derivation of the GENEX guidance law, the curvature control parameter is considered constant. The optimal value of the curvature control parameter varies with the PIP 160. As unexpected target motion occurs in the future, the PIP 160 slowly varies compared to the interceptor dynamics. This results in a slowly varying optimal value of the trajectory curvature parameter and leads to a system that can be considered to operate on two time-scales.

Time-scale separation enables the design of control algorithms that work on fast and slow loops 575 and 570 as seen in views 500 and 600. In time-scale separation, the states to be controlled at each layer are grouped by the "speed" of the dynamics for each layer. For exemplary embodiments, the fast states are the velocity and position of the missile 140 with the lateral acceleration as the control variable.

The state for the slow dynamics is the value of time $t_{ERAS}$ 330 and the trajectory curvature parameter K. The fast dynamics are controlled by the GENEX algorithm 530 and the slow dynamics are solved by an iterative algorithm using a simulation of the missile 140 to provide the value of time $t_{ERAS}$ 330. In the current substantiation, the concept is to enable the curvature of the trajectory to be changed during the flight by an alternative algorithm concept.

This exemplary concept comprises a model predicted control (MPC) algorithm to predict ahead via a non-linear simulation of the missile 140 flying the current GENEX parameters and determine the time $t_{ERAS}$ 330 spent in ERAS. The model predictive control (MPC) approach provides a technique for feedback control 575 for nonlinear systems where the dynamics are slow relative to the guidance update rate. Under model predictive control, a nonlinear simulation of the system projects the states onto a future receding horizon or fixed terminal horizon and uses the estimated states at the horizon to determine the control action.

This technique is used in industrial control, but the advent of fast computer processing for onboard vehicle use has facilitated its utility for controlling the slower processes on flight vehicles. The designer would specify the minimum acceptable value of time $t_{ERAS}$ 330 spent in the ERAS and an algorithm would then determine the value of the curvature parameter K to achieve this required time $t_{ERAS}$ 220 in ERAS.

To minimize the computational workload required for the MPC approach, the required number of trajectories should be limited. The global optimal does not need to be determined at each MPC update to ensure stability. P. O. M. Scokaert et al., "Suboptimal Model Predictive Control (Feasibility Implies Stability)" *IEEE Trans. on Automatic Control* 44(3) 1999, pp. 648-654 documents an iterative approach in which reduced performance at each iteration guarantees stability.

This thought inspires the exemplary concept of a slowly iterating approach that performs only a single update (and trajectory simulation) at each MPC update. This onboard simulation is initialized by the current estimated missile states from the navigation algorithm, with the simulation called once per iteration. The difference of the current estimate of the time of flight inside the ERAS of $t_{ERAS}$ 330 and the commanded time $t_{ERASC}$ in the ERAS is used to compute the estimated error computed error $t_{err}$ in achieved $t_{ERAS}$ values expressed by:

$$t_{err} = t_{ERASC} - t_{ERAS}. \tag{17}$$

For different polarity between the current time-of-flight error and the previous ERAS time error $t_{err_{k-1}}$ their product $f_1$ will be negative such that:

$$f_1 = t_{err} t_{err_{k-1}} < 0. \tag{18}$$

For this case, the value of curvature parameter K that zeros the error lies between the current value of K and the previous value of the curvature parameter $K_{k-1}$. Thus, for the case of $f_1<1$, the next value of the curvature parameter $K_{k+1}$ is given by:

$$K_{k+1} = \frac{K + K_{k+1}}{2}, \tag{19}$$

where k denotes the increment. If the value of $f_1>0$, then both the current and the previous values of the time-of-flight bias lie on the same side of the value that zeros (or minimizes) the error. For this case, the next value of the curvature parameter is changed based on the computed error $t_{err}$.

In this case, the next iteration of the curvature parameter $K_{k+1}$ is provided by:

$$K_{k+1} = K + k_t\left(\frac{K - K_{k-1}}{t_{err} - t_{err_{k-1}}}\right)t_{err}, \tag{20}$$

where $k_t$ is a user selectable gain nominally set to a value of one. This update is based on the linear approximation that the relationship between curvature K and the time error $t_{err}$ is linear in the neighborhood of the solution.

The selection for the fourth component of the curvature control is performed by two distinct algorithms during pre-launch and in-flight. The pre-launch algorithm creates a planned trajectory that satisfies the time in ERAS requirement. For the prediction during the pre-launch phase, all-round conditions are set at their nominal values. These may be optimized using digital simulations of the flight using any desired level of fidelity simulation and stored à priori into an implemented algorithm.

During implementation design, the guidance designer has the option of selecting three parameters: flight path angle $\gamma$, curvature K and final path angle $\gamma_f$. The nominal value of the curvature parameter K must be set to enable the in-flight algorithm sufficient control authority to correct for the in-flight variations. These might typically be done off-line and provide the initial values of $\gamma$, K and $\gamma_f$ from the offline tables generated as a function of the predicted intercept range, predicted cross-range, and predicted altitude, and target velocity vector at intercept.

Exemplary embodiments are implemented as shown in view 300 with a fast updating loop for the guidance commands and a slower loop to update the trajectory curvature algorithm. The initial values of the three GENEX parameters are provided by the pre-launch algorithm 555 and stored in a flight data load for access by the GENEX guidance algorithm 530.

Once the interceptor missile 140 has cleared the launcher and begun receiving updates on the missile and target position and velocity, the guidance loop 575 begins operating at a very high frequency to update the commanded acceleration to engage the target 110. The trajectory curvature algorithm 580 is then triggered after ten guidance loop updates and then updates in the slow loop 570 at a rate 1/10 of the guidance fast loop guidance loop 575.

Thus the slow loop 570 operates at a time interval about one order of magnitude longer than the fast loop 575. The updated trajectory curvature parameter is then updated in the flight data load for use by the faster guidance loop 575 computing the commanded accelerations 590 for the missile 140 towards the PIP 160 to engage the target 110.

The trajectory curvature parameter K remains unchanged and is not updated under conditions in which the trajectory curvature algorithm 580 cannot find a parameter value that satisfies the required time $t_{ERAS}$ value 330. Similarly, update does not occur under circumstances in which the trajectory curvature K yields an unacceptable miss distance.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A computer implementation processor for directing a missile during flight time by a radar towards an interception point of a moving target, said processor performing operations comprising:

determining look angle time to the interception point from the radar with a line-of-sight between the radar and the target, said look angle time being a portion of the flight time between the missile reaching said line-of-sight and the interception point;

providing an initial value of curvature gain;

updating said curvature gain from said look angle time during the flight time, said determining operation receiving said curvature gain in feedback; and receiving said curvature gain and physical characteristic information for the missile and providing acceleration command adjusted by said curvature gain to the missile.

2. The processor according to claim 1, wherein receiving operation receives said physical characteristic information in a first interval and said gain value in a second interval that is longer than said first interval.

3. The processor according to claim 2, wherein said second interval is an order of magnitude longer than said first interval.

4. The processor according to claim 1, wherein said determining operation receives input for target measurement state and missile measurement state.

5. The processor according to claim 1, further including providing said initial value of said gain to said determining operation.

6. The processor according to claim 1, wherein said determining operation calculates a cost function to minimize said acceleration command.

7. The processor according to claim 1, wherein said receiving operation provides said acceleration command for acceleration vector $\vec{a}_N$ determined by:

$$\vec{a}_N = \frac{V^2}{R}[K_2(\hat{r} - \hat{v}\cos\delta) - K_1(\hat{v}_f - \hat{v}\cos\mu)] - \vec{g},$$

where V is missile speed, R is slant range, $\hat{r}$ is a range-to-go unit vector, $\hat{v}$ is a missile velocity unit vector, $\hat{v}_f$ is a flight path unit vector, $\vec{g}$ denotes local gravity vector, $\cos\delta=\hat{r}\cdot\hat{v}$, $\cos\mu=\hat{v}_f\cdot\hat{v}$, $K_1=-(K+1)(K+2)$, and $K_2=(K+2)(K+3)$ with K being said curvature gain.

8. The processor according to claim 1, wherein said curvature gain has a value between zero and three.

9. The processor according to claim 1, wherein said updating operation updates said curvature gain K by:

$$K_{k+1} = K + k_t\left(\frac{K - K_{k-1}}{t_{err} - t_{err_{k-1}}}\right)t_{err},$$

where $K_{k+1}$ and $K_{k-1}$ are respective update and previous values of said curvature gain by increment k, $k_t$ is a selectable gain nominally set to one, and $t_{err}=t_{ERASC}-t_{ERAS}$ is error time such that $t_{ERAS}$ is said look angle time and $t_{ERASC}$ is command time.

* * * * *